US006102125A

United States Patent [19]

Calder

[11] Patent Number: 6,102,125

[45] Date of Patent: Aug. 15, 2000

[54] COILED TUBING WORKOVER RISER

[75] Inventor: Ian D. Calder, Beildside, United Kingdom

[73] Assignee: ABB Vetco Gray Inc., Houston, Tex.

[21] Appl. No.: 09/130,575

[22] Filed: Aug. 6, 1998

[51] Int. Cl.[7] ..... E21B 33/035; E21B 43/013

[52] U.S. Cl. ..... 166/359; 166/242.2; 166/242.3; 166/363; 166/367; 166/384; 405/195.1

[58] Field of Search ..... 166/97.5, 242.2, 166/242.3, 359, 363, 364, 367, 368, 384; 405/195.1, 224

[56] References Cited

U.S. PATENT DOCUMENTS

| | | | |
|---|---|---|---|
| 3,741,294 | 6/1973 | Morrill | 166/367 |
| 4,494,609 | 1/1985 | Schwendemann | 166/363 X |
| 4,502,543 | 3/1985 | Outhwaite | 166/359 |
| 4,607,701 | 8/1986 | Gundersen | 166/368 |
| 4,825,953 | 5/1989 | Wong et al. | 166/363 X |
| 5,335,729 | 8/1994 | Turner et al. | 166/384 X |
| 5,803,170 | 9/1998 | Garcia-Soule et al. | 166/242.3 |
| 5,819,852 | 10/1998 | Cunningham et al. | 166/359 X |

FOREIGN PATENT DOCUMENTS

WO 97/04211 2/1997 WIPO .

*Primary Examiner*—George Suchfield

*Attorney, Agent, or Firm*—Felsman, Bradley, Vaden, Gunter & Dillon, L.L.P.; James E. Bradley

[57] ABSTRACT

An apparatus for performing workover operations on a subsea well that has a subsea production tree with a production passage and an annulus access passageway. The subsea production tree is secured to a lower riser portion. The lower riser portion connects to the tree and has a production passage which registers with a production passage of the tree. The apparatus also has an annulus access passage which registers with the annulus access passage of the tree. The apparatus further includes a monobore riser which extends downward from the surface. A string of tubing, preferably coiled tubing, extends through the monobore riser and defines an inner riser passage and an annular riser passage. A circulation plug is secured proximate a lower end of the coiled tubing and is landed in the lower riser portion of the subsea well. The circulation plug communicates the inner riser passage with the annulus access passage. A flow-by passage is provided in the circulation plug to communicate the production passage with the annular riser passage.

14 Claims, 1 Drawing Sheet

COILED TUBING WORKOVER RISER

TECHNICAL FIELD

The present invention relates to a lightweight workover riser for use with a subsea well. In particular, the invention relates to a monobore workover riser wherein coiled tubing is introduced into the monobore riser and interfaced with a plug to effect circulation of the well. The plug is removable for running a wireline or coiled tubing into production tubing.

BACKGROUND ART

Well intervention operations on subsea wells have contributed to considerable increases in production. When a subsea well is in drilling mode, the necessary equipment includes a blowout preventor (BOP) stack, a disconnectable lower marine riser package and a marine riser portion. For well intervention through a subsea christmas tree, a different pressure control system is used comprising a safety package to contain the well, a disconnectable riser portion and a dual string workover riser system. One string communicates with the production tubing, while the other string communicates with the tubing annulus. These well intervention systems require complex and expensive handling and running systems that occupy a large amount of space on floating vessels. Such large systems may cause problems including limiting storage of other equipment.

Dual-string skeletal workover risers are used in two roles. One role is within the marine riser to run and retrieve a well completion tree. Second, dual-string skeletal workover risers are used to deploy the Christmas tree and intervention equipment in open water. In both cases, the equipment provides well control functions required in a well intervention role.

With a marine riser, the through riser equipment is not subjected to open-water environmental loads. Consequently, the equipment is not required to offer the structural integrity to resist the bending and tensile forces experienced in an open-water environment. However, the equipment does provide the well control functions required in a well intervention role.

It is desirable to create a system that offers all the functions of both a through-BOP and open-water system, but that provides a lightweight intervention role, i.e. one without a BOP stack, which was previously unavailable or impossible with existing systems.

Such a system may be achieved by providing a lightweight intervention system for use with single-bore and dual-bore intervention operations, which can be used with both horizontal trees, conventional trees and with wellheads without trees mounted thereon.

DISCLOSURE OF THE INVENTION

A lightweight workover riser is provided which is primarily monobore. However, during circulation from the annulus to production tubing in the well or during riser cleaning or flushing operations, coiled tubing is introduced into the monobore riser to effect circulation. Circulation is achieved by providing a circulation plug at the base of the coiled tubing that locks into a landing profile in the emergency disconnect portion (EDP) of the lower riser package. The circulation plug provides access to the normal EDP annulus flowpath.

In operation, workover operations are performed on a subsea well that has a subsea production tree with a production passage and an annular access passage, wherein the tree is secured to the lower riser portion by the following method. First, a lower riser portion is connected to the tree, wherein the lower riser portion has a production passage adapted to register with the production passage of the tree. Additionally, an annular access passage is adapted to register with the annular access passage of the tree. A monobore riser is connected to the lower riser portion. A circulation plug is secured in the EDP of the lower riser passage. The circulation plug has a lateral annulus access passageway that communicates a central bore with an inner riser passage. The circulation plug also has a passageway that communicates the production passage with an annular riser passage. The string of tubing is lowered through the monobore riser and landed in the circulation plug for communication with the central bore. By providing such a system, circulation from the annulus to the production tubing in the well may be achieved while providing circulation access through the normal EDP flowpath.

BEST MODE FOR CARRYING OUT THE INVENTION

Figures 1, 2:
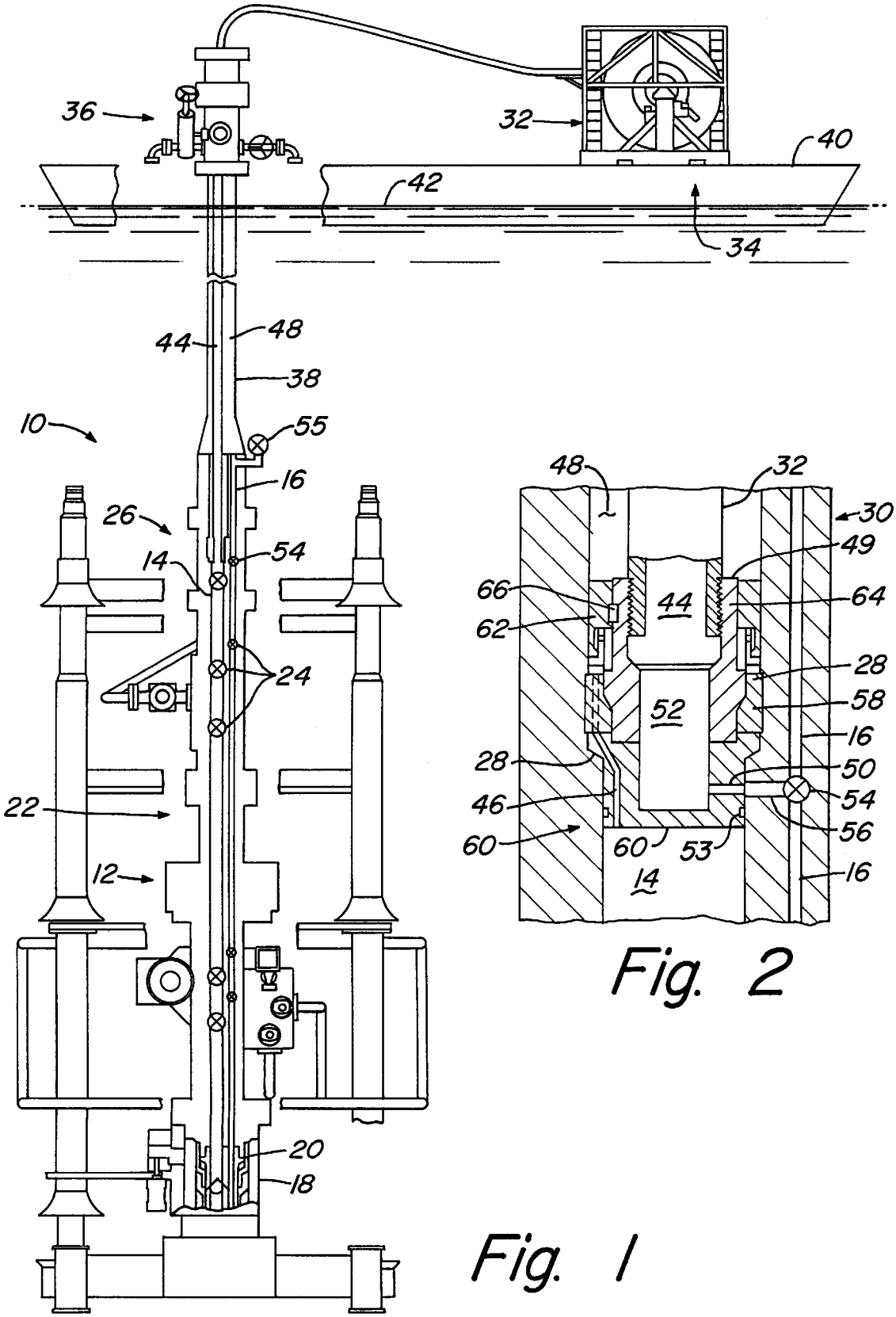
FIG. 1 is a schematic view of a workover riser for deep water applications.
FIG. 2 is an enlarged sectional view of the circulation plug of the workover riser of FIG. 1.

Referring to FIGS. 1 and 2, an apparatus 10 is shown for performing workover operations on a subsea well having subsea production tree 12. Production tree 12 is conventional, having a production passage or main bore 14 and an annulus access bore 16. In the embodiment shown, production passage 14 and annular passage 16 are parallel and extend through tree 12. Tree 12 is mounted on a subsea wellhead 18, which has a tubing hanger 20 connected to a string of tubing extending into the well. Tubing hanger 20 has mating production and annulus passages, which are connected to the tree production and annulus bores 14 and 16. Although a conventional tree is shown, a horizontal tree could be used, except that the tubing hanger would be landed in the tree, rather than the wellhead housing.

The apparatus 10 includes a lower riser portion (LRP) 22 that is releasably connected to tree 12, wherein lower riser portion 22 has production passage 14 and is adapted to register with the production passage 14 of tree 12. Lower riser portion 22 further includes a parallel annulus access passage 16 that is adapted to register with annulus access passage 16 of tree 12. Annulus passage 16 is formed in the wall of LRP 22. Preferably, valves 24 are positioned in the LRP 22 in both main bore 14 and annular bore 16 so that flow through bore 14 and 16 may be controlled as necessary. An emergency disconnect portion (EDP) 26 is positioned above lower riser portion 22.

A landing profile 28 is located in EDP 26 for receiving circulating plug 30. Coiled tubing 32 is deployed by reel 34 and is fed through surface/tree lubricator 36 down monobore riser 38 where coiled tubing 32 engages circulating plug 30. Preferably, tree/lubricator 36 is provided on an upper end of monobore riser 38. Surface tree/lubricator 36 seals around the string of coiled tubing 32, which is deployed from a reel 34. Monobore riser 38 is adapted to extend downward from a vessel 40 at surface 42. Monobore riser 38 is preferably an 8 inch diameter riser comprised of titanium composite or composite hybrid that is steel lined. Circulation plug 30 is landed in emergency disconnect package (EDP) 26 and communicates coiled tubing passage 44 with annular access passage 16. Circulation plug 30 additionally has flow-by passageway 46, which communicates production passage 14 with the annular riser passage 48. Coiled tubing 32 extends through surface tree lubricator 36 and through monobore riser 38, thereby defining a coiled tubing passage 44 and an annular passage 48. Flow-by passageway 46 communicates production passage 14 with annular riser passage 48. Circulating plug 30 includes lateral annulus access passageway 50, which communicates annulus access passage 16 with central bore 52 but is isolated from production bore 14 by seals 53. Central bore 52 receives coiled tubing 32 and is closed on its lower end. A two-way valve 54 is preferably provided at the junction of annular bore 16 and annulus port 56 so that fluid flow may be directed into coiled tubing passage 44 from annular bore 16 or may be directed up annular bore 16 past two way valve 54, to an external annulus access 55.

Preferably, production passage 14 and annular access passage 16 in lower riser portion 22 are parallel, and annulus access passage 16 is smaller in diameter than production passage 14. Additionally, the preferred embodiment of EDP 26 has annulus port 56 that extends laterally from production passage 14 to annular access passage 16, wherein annulus port 56 registers with annulus access passageway 50. A two-way valve 54 is preferably positioned at the junction of annulus access passage 16 and annulus port 56 so that fluid flow may be directed 5 into coiled tubing passage 44 from annulus access passage 16 or may be directed up annulus access passage 16 past two way valve 54 to external annulus access 55. In the preferred embodiment, emergency disconnect package 26 has a landing profile 28 for engagement with lock member 58 of plug 30. Plug 30 includes lower body 60 and upper body 62 and has seals (not shown) to seal plug 30 in production bore 14. Upper body 62 consists of inner sleeve 64, which is moveable relative to upper body 62. Inner sleeve 64 has a cam on its exterior surface that engages locking members 58 and is used to force locking members 58 into locking engagement with landing profile 28 when landing. A secondary ratchet lock mechanism 66 in the upper body 62 provides a lock to prevent accidental release. Coiled tubing 32 is secured to threads in inner sleeve 64. Lifting coiled tubing 32 in a controlled manner causes the ratchet lock 66 to release and lock member 58 to retract. Flowby passage 46 extends through lower body 60, lock member 58 and through upper body 62 as indicated by the dotted lines.

In practice, riser 38 is lowered into the sea along with lower riser portion 22 and EDP 26. Lower riser portion 22 lands on and is secured to a production tree 12. The production passage 14 of lower riser portion 22 registers with production passage 14 of tree 12. Annular access passage 16 in lower riser portion 22 registers with annular access passage 16 of tree 12. Coiled tubing 32 is deployed from reel 34 and pushed through lubricator 36 into riser 22. Circulation plug 30 is secured to the lower end of coiled tubing 32 and landed on landing profile 28. Lateral annulus access passageway 50 communicates central bore 52 and coiled tubing passage 44. The operator may circulate fluid by pumping down coiled tubing 32. Fluid flows past plug 30 through flow-by passage 50. Normally, a valve 54 will be open in the emergency disconnect package 26 of the string allowing fluids to circulate down the annulus and into the production tubing. Fluid flows down annulus and back up production tubing. Fluid returns by flowing first through production tubing 14, then through flowby passage 46 and finally up passage 48 in the monobore riser. Reverse circulation is also possible.

This invention allows the use of a lightweight, small diameter monobore riser for subsea workover operations, and the circulation inset 44 is only deployed when required.

Another advantage of the invention is that coiled tubing may be utilized for riser cleaning or flushing operations. An additional advantage is that coiled tubing runs through the monobore riser rather than along the exterior of the monobore riser.

While the invention is been shown in only one of its forms, it should be apparent to those skilled in the art that it is not so limited, but is susceptible to various changes without departing from the scope of the invention. For example, a horizontal tree could be employed, which has a tubing hanger in the tree rather than the wellhead. Production flow would then be directed through a lateral passage in the tubing hanger.

What is claimed is:

1. An apparatus for performing workover operations on a subsea well comprising:

a lower riser portion for connecting to a subsea production tree, said lower riser portion having a production passage adapted to register with the production passage of said tree, and an annulus access passage adapted to register with an annulus access passage in said tree;

a monobore riser extending upward from the lower riser portion to the surface;

a string of tubing extending from the surface through said monobore riser, defining an inner riser passage and annular riser passage; and a circulation plug secured proximate a lower end of the tubing and landed in said lower riser portion, said circulation plug having a first passage communicating the production passage in said lower riser portion with one of the riser passages, and a second passage communicating the annulus access passage in said lower riser portion with the other of the riser passages.

2. The apparatus for performing workover operations according to claim 1 wherein the first passage communicates the production passage in said lower riser portion with said annular riser passage.

3. The apparatus for performing workover operations according to claim 1 wherein the first passage is a flow-by passageway extending through the plug which communicates said production passage in said lower riser portion with said annular riser passage, and the second passage is a lateral annulus access passageway that communicates said annulus access passage in said lower riser portion with said inner riser passage.

4. An apparatus for performing workover operations according to claim 1 wherein said string of tubing is coiled tubing.

5. An apparatus for performing workover operations according to claim 1 wherein said production passage and said annulus access passage in said lower riser portion are parallel and offset axially from one another, with said annulus access passage in said lower riser portion being smaller than said production passage in said lower riser portion.

6. An apparatus for performing workover operations according to claim 1 wherein said production passage and said annulus access passage in said lower riser portion are parallel, with said annular riser passage in said lower riser portion being smaller in flow area than said production passage in said lower riser portion, and said annulus access passage in said lower riser portion extends axially through a wall of the lower riser portion.

7. An apparatus for performing workover operations according to claim 1 wherein said production passage and said annulus access passage in said lower riser portion are parallel, with said annulus access passage in said lower riser portion being smaller than said production passage in said lower riser portion and comprising an axial portion extending axially through a wall of said lower riser portion and a lateral portion extending laterally from said axial portion to the production passage of said lower riser portion.

8. An apparatus for performing workover operations according to claim 1 wherein said lower rise portion has a landing profile, and said circulation plug has a lock member that engages said landing profile.

9. An apparatus for performing workover operations on a subsea well comprising:

a lower riser portion for connecting to a subsea production tree said lower riser portion having a production passage adapted to register with a production passage of said tree, and an annulus access passage adapted to register with an annulus access passage of said tree, wherein said lower riser portion has a landing profile;

a monobore riser portion extending upward from the lower riser portion to the surface;

a string of coiled tubing extending from the surface through said monobore riser, defining inner and annular riser passages; and a circulation plug secured to a lower end of the tubing and landed in the production passage in said lower riser portion, said circulation plug having a flow-by passage which communicates said production passage of said lower riser portion below said circulation plug with said annular riser passage and having a lateral annulus access passageway which communicates said annulus access passage of said lower riser portion with said inner riser passage, said circulation plug having a lock member that engages said landing profile.

10. An apparatus for performing workover operations according to claim 9 wherein said circulation plug comprises:

a lower body and an upper body, said upper body being connected to said lower end of coiled tubing and being axially movable from upper and lower positions relative to said lower body, the lock member being carried by the upper and lower bodies and being movable to a locked position in response to movement of the bodies relative to each other;

a central bore in said upper and said lower body, said central bore in said lower body being closed at a lower end of said lower body and open at an upper end to the interior of the coiled tubing; and wherein the lateral annulus access passageway is located in said lower body and communicates said central bore with said annulus access passage in said lower riser portion.

11. An apparatus for performing workover operations according to claim 9 further comprising a lubricator mounted to an upper end of the monobore riser portion, wherein said string of coiled tubing passes sealingly through the lubricator.

12. An apparatus for performing workover operations according to claim 9, further comprising a valve in said annulus access passage in said lower riser portion and a valve in said production passage in said lower riser portion.

13. A method for performing workover operations on a subsea well having a subsea production tree comprising the steps of:

connecting a monobore riser to a lower riser portion, which has a production passage adapted to register with a production passage of the tree, and an annulus access passage adapted to register with an annulus access passage of the tree;

lowering the monobore riser and connecting the lower riser portion to the subsea production tree;

engaging a circulation plug which has first and second passages to a string of tubing;

lowering the string of tubing and the circulation plug through the monobore riser and landing the circulation plug in the lower riser portion, defining an inner riser passage in the string of tubing and an annulus riser passage surrounding the string of tubing; and with said first passage, communicating the annular access passage of said lower riser portion with one of the passages in said monobore riser and with said second passage, communicating the production passage of said lower riser portion with the other of the passages in said monobore riser.

14. The method of performing workover operations according to claim 13 further comprising the step of:

communicating said production passage in said lower riser portion with said annulus access passage in said lower riser portion.

* * * * *

UNITED STATES PATENT AND TRADEMARK OFFICE

CERTIFICATE OF CORRECTION

PATENT NO. : 6,102,125
DATED : May 15, 2000
INVENTOR(S) : Ian D. Calder

It is certified that error appears in the above-indentified patent and that said Letters Patent is hereby corrected as shown below:

Column 3, Line 28, after "directed", delete "5".

Column 5, Line 11, delete "rise" and insert --riser--.

Column 5, Line 18, delete "tree" and insert --tree;--.

Signed and Sealed this

Tenth Day of April, 2001

*Attest:*

Nicholas P. Godici

NICHOLAS P. GODICI

*Attesting Officer*

*Acting Director of the United States Patent and Trademark Office*